United States Patent [19]

Rozner et al.

[11] 4,372,213

[45] Feb. 8, 1983

[54] MOLTEN METAL-LIQUID EXPLOSIVE METHOD

[75] Inventors: Alexander G. Rozner, Potomac; Horace H. Helms, Silver Spring, both of Md.

[73] Assignee: The United States of America as represented by the Secretary of the Navy, Washington, D.C.

[21] Appl. No.: 249,046

[22] Filed: Mar. 30, 1981

Related U.S. Application Data

[62] Division of Ser. No. 28,478, Apr. 9, 1979, Pat. No. 4,280,409.

[51] Int. Cl.[3] ..... C06D 5/00

[52] U.S. Cl. ..... 102/301; 102/364; 149/37

[58] Field of Search ..... 102/364, 301, 327; 149/37

[56] References Cited

U.S. PATENT DOCUMENTS

| | | | |
|---|---|---|---|
| 1,417,075 | 5/1922 | La Cour et al. | 149/15 |
| 2,509,710 | 5/1950 | Van Loenen | 102/364 |
| 2,892,406 | 6/1959 | Hradel et al. | 149/37 |
| 3,054,349 | 9/1962 | Plumley | 102/364 |
| 3,291,050 | 12/1966 | Ahlert et al. | 102/364 |
| 3,471,347 | 10/1969 | Cross et al. | 149/74 |
| 3,503,814 | 3/1970 | Helms et al. | 149/2 |
| 3,507,720 | 4/1970 | Peterson | 149/74 |
| 3,695,951 | 10/1972 | Helms et al. | 149/44 |
| 4,193,388 | 3/1980 | Frosch | 149/37 |

*Primary Examiner*—Edward A. Miller
*Attorney, Agent, or Firm*—R. S. Sciascia; A. L. Branning; R. D. Johnson

[57] ABSTRACT

An explosive device comprising:

(1) a metal liner composed of a metal selected from the group consisting of aluminum, magnesium, copper, and brass, the liner enclosing a chamber;

(2) a liquid contain in the chamber;

(3) a layer of pyrotechnic material surrounding the outside of the liner, the pyrotechnic material composed of a mixture of powders of (a) nickel;

(b) metal oxide; and (c) an aluminum containing component which may be (i) aluminum or (ii) a mixture of from 50 to less than 100 weight percent of aluminum and from more than zero to 50 weight percent of a metal which can be magnesium, zirconium, bismuth, beryllium, boron, tantalum, copper, silver, niobium, or mixtures thereof; and (4) means for igniting the pyrotechnic material. This device is useful as an explosive, particularly as an underwater explosive.

10 Claims, 4 Drawing Figures

MOLTEN METAL-LIQUID EXPLOSIVE METHOD

This is a division of application Ser. No. 028,478 filed on Apr. 9, 1979, now U.S. Pat. No. 4,280,409.

BACKGROUND OF THE INVENTION

This invention relates to explosive devices and more particularly to steam or vapor explosive devices.

Conventional chemical explosives are frequently sensitive to heat and impact. Moreover, they generally yield toxic fumes when they burn as in a fire. Thus, these conventional explosives require special handling and storage precautions.

A phenomena of considerable industrial importance in recent years and one that may have significant military application is so called vapor explosion, often referred to as thermal explosion or steam explosion. This phenomena results from the extremely rapid heat transfer from hot liquid (e.g., molten metal) when introduced into cold liquid (e.g., water). Sporadic explosions resulting from this phenomena have been responsible for loss of life and property in industry for a number of years and efforts have been made to understand the extreme violence of these interactions. It is not presently known if these explosions are a result of liquid entrapment, flash of superheated liquid, collapse of vapor cavities, metal-water chemical reaction, hydrogen-oxygen reactions, or a combination of these things. However, resultant effects of these interactions are drastic, and substantial amounts of energy are released during such explosions. It would be desirable to provide moderate sized, high energy explosive devices based on vapor explosions. Such devices would have to be compact, self-contained, and have a relatively short initiation to explosion time.

SUMMARY OF THE INVENTION

Accordingly, one object of this invention is to provide an explosive device.

Another object of this invention is to provide an explosive device which is insensitive to impact, friction, shock and elevated temperature.

Yet another object of this invention is to provide a thermally stable explosive device which is less likely to detonate in a fire than organic chemical explosives are.

Another object of this invention is to provide an explosive device which will not burn or decompose to yield toxic vapors.

A further object of this invention is to provide an explosive device having a high energy to weight yield ratio.

These and other objects of this invention are accomplished by providing:

an explosive device comprising (1) a metal liner composed of a metal selected from the group consisting of aluminum, magnesium, copper, and brass, the liner enclosing a chamber;

(2) a liquid contained in the chamber;

(3) pyrotechnic material surrounding the outside of the metal liner, the pyrotechnic material comprising a mixture of powders of (a) nickel;

(b) metal oxide; and (c) an aluminum containing component selected from the group consisting of (i) aluminum and (ii) a mixture of from 50 to less than 100 weight percent of aluminum and from more than zero to 50 weight percent of a metal selected from the group consisting of magnesium, zirconium, bismuth, beryllium, boron, tantalum, copper, silver, niobium, and mixtures thereof; and (4) means for igniting the pyrotechnic material.

In one variation of this device, the chamber is left empty and means are provided for allowing a liquid to enter the chamber when the device is placed into that liquid. In a second chamberless variation of the device, the pyrotechnic material and ignition means are put into a case made of a metal selected from the group consisting of aluminum, magnesium, copper, and brass. These last two variations of the device are limited to use in a body of a liquid (e.g., water as in the ocean or river). Moreover, the preferred use of the first design of the device is as an underwater explosive.

BRIEF DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein.

DETAILED DESCRIPTION OF THE PREFERRED EMBODIMENT

Figure 1:
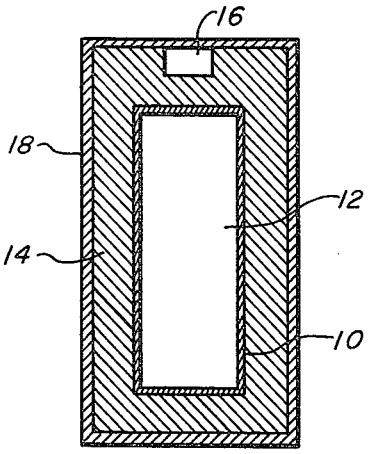
FIG. 1 shows a side cross-sectional view of the preferred closed chamber molten metal-liquid explosive device.

Referring now to the drawings wherein like reference characters designate identical or corresponding parts through out the several figures, and more preferably to FIG. 1 which shows a side cross-sectional view of the preferred closed chamber molten metal-liquid explosive device which is shown to include a metal liner 10 which encloses a chamber 12 which contains a liquid. A layer of a special pyrotechnic material 14 surounds the metal liner 10 and is in contact with an igniter 16. Preferably, outer casing 18 is used to enclose and protect the ignitor 16, pyrotechnic material 14, metal liner 10, and liquid in chamber 12. However, as Examples 1–4 demonstrate, these molten metal-liquid explosives will work without this outer protective casing. In operation, the igniter 16 raises the temperature of pyrotechnic material 14 to the melting point of aluminum (660° C.) at which point the pyrotechnic material 14 ignites, causing the metal liner 10 to melt. Molten metals from both the pyrotechnic material 14 and metal liner 10 come into contact with the cooler liquid which was contained in the chamber 12 causing a energetic vapor or steam explosion.

The pyrotechnic material must be thermally stable up to about 600° C. and must be insensitive to shocks. On the other hand, the pyrotechnic material must rapidly ignite to generate high temperatures and large quantities of heat. It has been discovered that a group of pyrotechnic mixtures call "Pyronols" satisfy these requirements.

The Pyronols used in this device are mixtures of powders of nickel, metal oxide, and an aluminum containing component. Nickel preferably constitutes from 5 to 50 and more preferably from 20 to 45 weight percent of the pyrotechnic powder mixture. Of the metal oxides $Fe_2O_3$, $Fe_3O_4$, CuO, $Cr_4O_3$, $Co_3O_4$, or mixtures thereof are preferred, with $Fe_2O_3$ or CuO being more preferred. The metal oxide preferably constitutes from 20 to 76 and more preferable from 30 to 65 weight percent of the pyrotechnic powder mixture.

The aluminum containing component may be aluminum powder or a mixture of from more than 50 to less than 100 weight percent of aluminum powder and from more than zero to 50 weight percent of a metal powder which is magnesium, zirconium, bismuth, beryllium, boron, tantalum, copper, silver, niobium, tungsten, molybdenum, or mixtures thereof. The aluminum containing component preferably constitutes from 15 to 50 and more preferably from 20 to 35 weight percent of the pyrotechnic powder mixture.

As disclosed in U.S. Pat. No. 3,503,814, these pyrotechnic mixtures can be ignited in various conventional ways and once initiation occurs, the propagation velocity becomes a function of composition and density among other factors. For example, compressed powder configurations or pellets made from these mixtures can be ignited by placing them in contact with loose powder of the same composition and then igniting the powder by means of small heating elements, electric matches or conventional ordnance igniter systems.

Metals or alloys used as liners 10 must not melt below the ignition temperature of the pyrotechnic mixture but must melt below the temperature generated by the ignited pyrotechnic mixture. Generally, a metal or alloy melting in the range of from 600° C. to 1400° C. will work well. Obvious, conventional factors, such as strength, cost, ease of fabrication, corrosion resistance, are also taken into consideration. Liners made of aluminum, copper, magnesium, or brass are preferred, with aluminum liners being most preferred.

The weight of metal used for the liner should be minimized. The ratio of the wall thickness to total diameter of the liner should be from 0.05 to 0.15, and preferrably from 0.05 to 0.10. The liner shape is preferrably cylindrical because it will be easier to machine. The liner, however, could be in other shapes such as spherical.

The liquid in the chamber 12 may be water or any other liquid (e.g., organic solvents, nitric acid, etc.). Water is the most preferred solvent because, it is notoxic, nonflammable, and inexpensive. A combination of water and an antifreeze (e.g., ethylene glycol) may be used for low temperature environments. The amount of liquid used in the preferred embodiment (FIG. 1) is from 6 to 15 weight percent of the weight of the pyrotechnic material used. The chamber 12 of the open chambered device (FIG. 2) is also designed to hold 6 to 15 weight percent of liquid based on the weight of the pyrotechnic material.

In the event of a fire, the liquid must be able to escape from the molten metal-liquid explosive device. Otherwise, an explosion may occur. This may be done by using a rupturable membrane or similar structure. A plug made out of a low melting alloy would be screwed into the case over the membrane prior to activation of the molten metal-liquid explosive device. Another approach would be to store the device and liquid separately and then fill the chamber just prior to use.

Use of either the membrane or separate storage technique will also prevent the case from cracking should the liquid freeze during storage. If the liquid is water, antifreeze or alcohol can be added to help prevent freezing. Another approach is to leave room in the chamber for the ice to expand.

Figure 2:
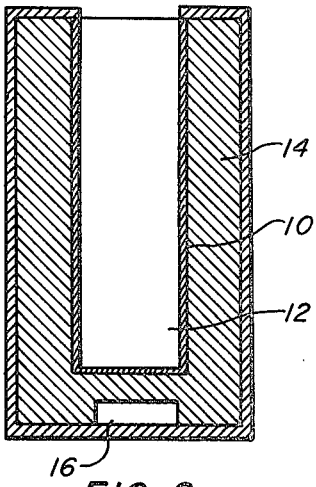
FIG. 2 shows a side cross-sectional view of an open chamber molten metal-liquid explosive device.

FIG. 2 shows a side cross-sectional view of an open chamber molten metal-liquid explosive device which is shown to include a metal liner 10 which defines a chamber 12. The chamber 12 does not contain a liquid; instead an opening 20 is provided to permit a liquid (e.g., water) to enter the chamber from the external environment (e.g., ocean, river, lake). The opening 20 may simply be a hole or it may be a one-way valve or other state of the art device. Other than that, the metal liner 10, pyrotechnic material 14, and igniter 16 are of the same composition and construction as the close chambered device described above. Again, it is preferable to include a protective outer case 18. In use the device would be put into the liquid and the chamber 12 would be allowed to fill with the liquid. The device would then be detonated by igniting the pyrotechnic material 14.

Figure 3:
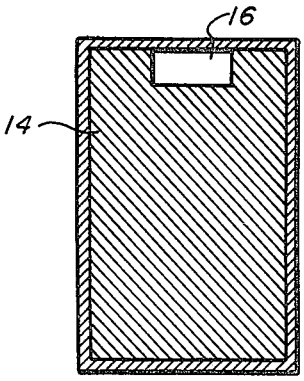
FIG. 3 shows a side cross-sectional view of a chamberless molten metal-liquid explosive device.

FIG. 3 shows a side cross-sectional view of a simpler but less effective chamberless molten metal-liquid explosive device which is shown to include a pyrotechnic material 14, an igniter 16 in contact with the pyrotechnic material, and an outer casing 18 enclosing the igniter 16 and pyrotechnic material 14. The casing 18 is made of magnesium, aluminum, copper, or brass. This device must be placed in a liquid for it to detonate. Moreover, the energy of the explosion is dissipated faster than with the devices described above. The effectiveness of the explosion can be increased by placing the device in a confined space such as a bore hole.

The general nature of the invention having been set forth, the following examples are presented as specific illustrations thereof. It will be understood that the invention is not limited to these specific examples, but is susceptible to various modifications that will be recognized by one of ordinary skill in the art.

EXAMPLES

The mix No. 1 CuO used in the following examples had the following composition by weight:

Nickel powder: 15.5
aluminum powder: 21.4
CuO powder: 63.1

The particle sizes for these powders were 44 to 200 microns for nickel, about 50 microns average for CuO, and less than 74 microns for aluminum. Powders having submicron size particles are hazardous and were avoided.

Figure 4:
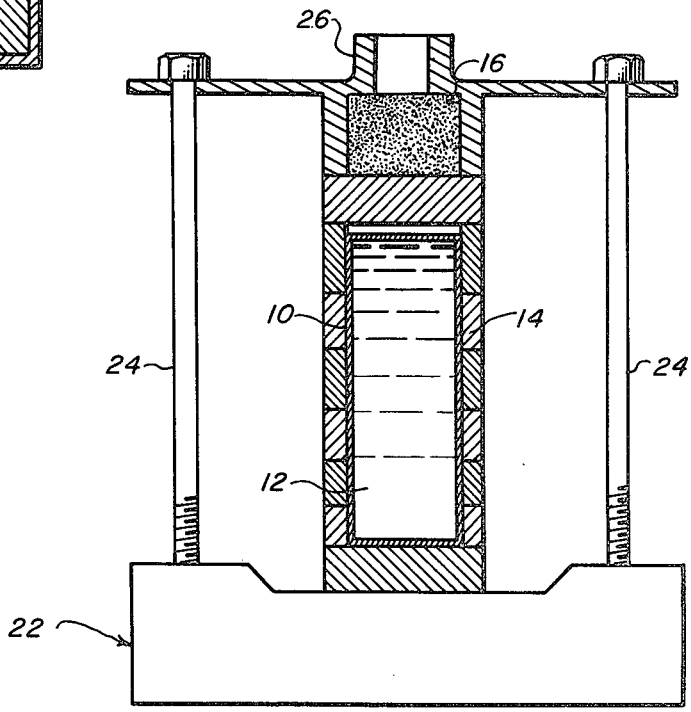
FIG. 4 shows a side cross-sectional view of the test molten metal-liquid explosive devices used in examples 1, 2, and 3 of the experimental section.

A side cross-sectional view of the test apparatus used in examples 1, 2, and 3 is shown in FIG. 4.

EXAMPLE 1

A aluminum liner 10, weighing 2.6 grams, was filed with 11 grams of water 12 and sealed. The liner 10 was placed inside of a well drilled in cold pressed pyrotechnic mix No. 1 CuO pellets 14. The pellets had been formed by cold pressing 74 grams of the mix No. 1 CuO. The pellets 14 and liner 10 were placed on a retaining stand 22 and secured into place with the igniter plate 16 and threaded rods 24. A Holex TM igniter 26 was used to initiate the reaction of the pyrotechnic pellets 14. About 0.2 seconds after the initiation, an explosion occurred when the molten products of the pyrotechnic pellets 14 and molten aluminum from the liner 10 contacted the water 12.

EXAMPLE 2

Same as example 1 except a 7.5 gram brass liner was used in place of the aluminum liner. As in Example 1, an explosion occurred about 0.2 seconds after initiation when molten products of the pyrotechnic pellets 14 and molten brass from the liner 10 contacted the water 12.

The intensity of light was higher in Example 1 where an aluminum liner was used than in Example 2 where a brass liner was used.

EXAMPLE 3

Same as example 1 except that the aluminum liner weighed 6.08 grams, was filled with 15 grams of water; and was placed in a well drilled in 110 grams of cold pressed mix No. 1 CuO pyrotechnic pellets. Again, about 0.3 seconds after initiation an explosion occurred when molten product reacted with water.

EXAMPLE 4

230 grams of mix No. 1 CuO cold pressed pyrotechnic pellet was placed in a thin wall aluminum cylinder weighing 51 grams. The cylinder with the pellets was placed in an open glass jar filled with 50 grams of water. The explosion occurred about 0.1 seconds after initiation.

High speed photograph (1000 frames/sec.) was used to record the explosions of examples 3 and 4.

Obviously, numerous modifications and variations of the present invention are possible in light of the above teaching. It is therefore to be understood that within the scope of the appended claims the invention may be practiced otherwise than as specifically described herein.

What is claimed and desired to be secured by Letters Patent of the United States is:

1. A method of causing an explosion comprising the following steps in order:

A. Placing a thermal device in a confined space which is filled with a liquid which consists essentially of water, wherein the thermal device comprises (1) pyrotechnic material comprising a mixture of powders of (a) nickel, (b) metal oxide, (c) an aluminum containing component selected from the group consisting of (i) aluminum and (ii) a mixture of from 50 to less than 100 weight percent of aluminum and from more than zero to 50 weight percent of a metal selected from the group consisting of magnesium, zirconium, bismuth, beryllium, boron, tantalum, copper, silver, niobium, tungsten, and mixtures thereof;

(2) means for igniting the pyrotechnic material; and (3) a case enclosing the pyrotechnic material and the ignition means, wherein the case is composed of a metal selected from the group consisting of aluminum, magnesium, copper, and brass; and B. igniting the pyrotechnic material of the thermal device to cause the explosion in the confined space.

2. The method of claim 1 wherein the metal oxide of the pyrotechnic material is selected from the group consisting of $Fe_2O_3$, $Fe_3O_4$, CuO, $Cr_4O_3$, $Co_3O_4$, and mixtures thereof.

3. The method of claim 2 wherein the metal oxide of the pyrotechnic material is selected from the group consisting of $Fe_2O_3$, CuO, and mixtures thereof.

4. The method of claim 1 wherein the pyrotechnic material is comprised of (a) from 15 to 50 weight percent nickel, (b) from 20 to 76 weight percent of metal oxide, and (c) from 15 to 50 weight percent of the aluminum containing component.

5. The method of claim 4 wherein the pyrotechnic material is comprised of (a) from 15 to 45 weight percent of nickel, (b) from 30 to 65 weight percent of metal oxide, and (c) from 20 to 35 weight percent of the aluminum containing component.

6. The method of claim 1 wherein the pyrotechnic material is composed of powders of (a) nickel, (b) metal oxide, and (c) aluminum.

7. The method of claim 1 wherein the case is made of aluminum.

8. The method of claim 1, 2, 3, 4, 5, or 7 wherein the liquid consists essentially of sea water.

9. The method of claim 1, 2, 3, 4, 5, 6, or 7 wherein the liquid consists essentially of fresh water.

10. The method of claim 1, 2, 3, 4, 5, 6, or 7 wherein the confined space is a bore hole.

* * * * *